United States Patent [19]

Carter

[11] Patent Number: 5,074,350

[45] Date of Patent: Dec. 24, 1991

[54] UNIBODY MOUNTING BRACKET FOR VENETIAN BLINDS

[76] Inventor: John R. Carter, 21441 Carol Sue La., Saugus, Calif. 91350

[21] Appl. No.: 655,128

[22] Filed: Feb. 14, 1991

Related U.S. Application Data

[63] Continuation-in-part of Ser. No. 555,897, Jul. 20, 1990, abandoned.

[51] Int. Cl.[5] ..... E06B 9/30

[52] U.S. Cl. ..... 160/178.1; 160/902; 248/262; 16/94 R

[58] Field of Search ..... 160/902, 178.1, 38, 160/39, 19; 248/262, 267, 264; 16/94 R, 94 D

[56] References Cited

U.S. PATENT DOCUMENTS

| | | | |
|---|---|---|---|
| 2,698,727 | 1/1955 | Rutledge | 248/264 |
| 3,169,006 | 2/1965 | Lorentzen et al. | 248/262 |
| 4,224,974 | 9/1980 | Anderson et al. | 160/178 |
| 4,265,423 | 5/1981 | Vecchiarelli. | |
| 4,475,706 | 10/1984 | Anderson | 248/542 |
| 4,607,818 | 8/1986 | Georgopoulos | 248/544 |
| 4,802,644 | 2/1989 | Oskam | 248/251 |
| 4,919,185 | 4/1990 | Comeau et al. | 160/178.1 |
| 4,938,443 | 7/1990 | Rowe | 248/251 |

*Primary Examiner*—Blair M. Johnson
*Attorney, Agent, or Firm*—Harlan P. Huebner

[57] ABSTRACT

A bracket for mounting a headrail of a venetian blind to a support surface such as a wall or ceiling. More specifically, a bracket comprising a platemeans having front and rear legs projecting downwardly and outwardly therefrom, and each of said legs including arresting means and said legs being resilient to assume a relatively tight fit of said headrail against said platemeans.

11 Claims, 2 Drawing Sheets

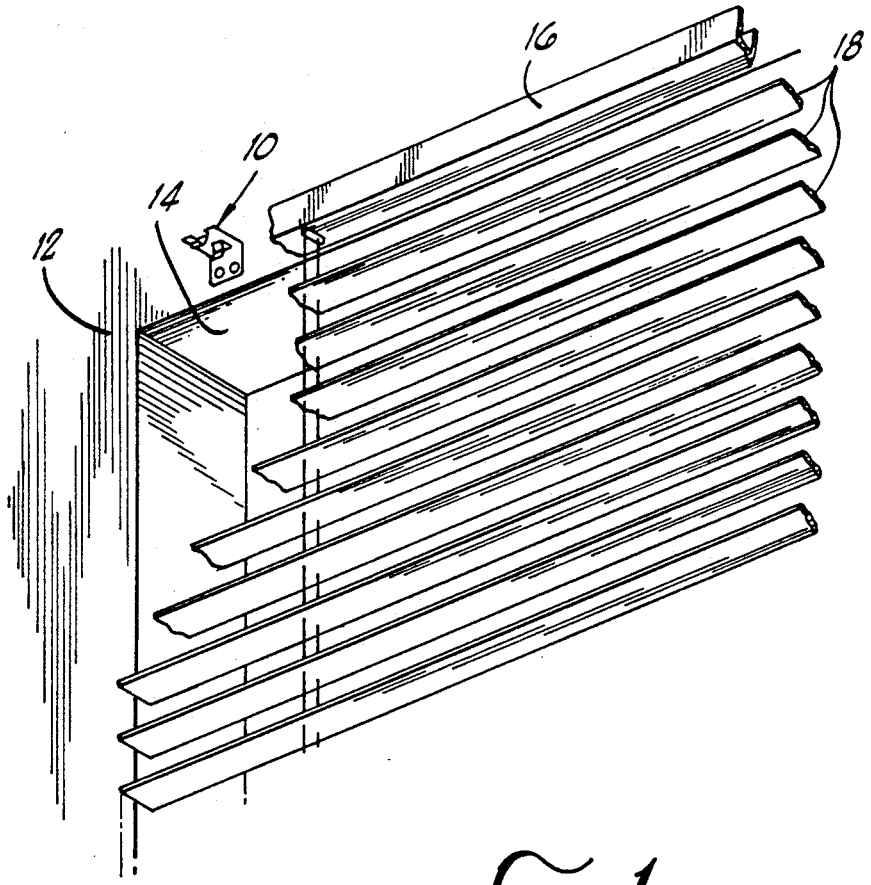
FIG. 1
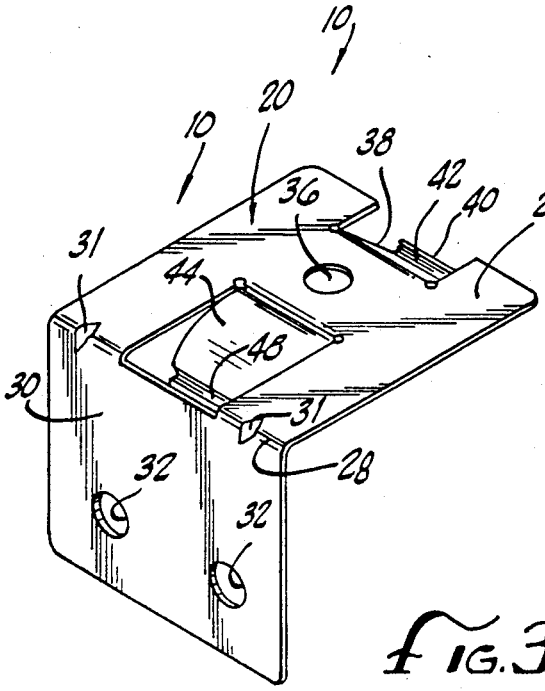
FIG. 3.
FIG. 2.
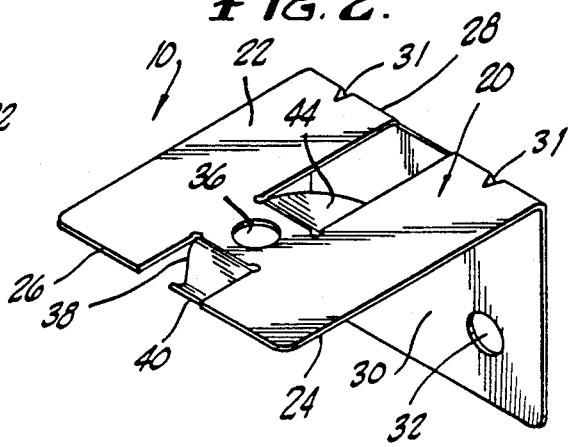

UNIBODY MOUNTING BRACKET FOR VENETIAN BLINDS

1. PRIOR APPLICATION

This application is a continuation in part of Ser. No. 07/555,897, filed July 20, 1990, now abandoned.

2. FIELD OF THE INVENTION

This invention relates to venetian blinds, and more specifically to a bracket for mounting the headrail of a venetian blind to a horizontal or vertical surface.

BACKGROUND OF THE INVENTION

To understand how prior art brackets for venetian blinds have worked, one must first understand the construction of venetian blind headrails. The headrails typically extend the full width of the venetian blind. They typically are U-shaped comprising a bottom web having two parallel flanges extending perpendicular from the respective edges of the web. Finally, the flanges terminate in inwardly curled lips. The resulting structure forms a channel into which the inwardly curled lips extend.

Heretofore, brackets for venetian blind headrails have usually been mounted at the ends of such headrails. Such conventional brackets have usually been supplied in pairs of differing configuration, one for each end of the headrail. Said brackets frequently have had a hinged door, which when opened, encapsulate the U-shaped channel of the headrail.

U.S. Pat. No. 4,265,423 to Vecchiarelli disclosed a typical bracket of this type. Because the end brackets extend above the headrail, they are readily observable. Thus, such brackets must be painted to match the headrail. This is a disadvantage by virtue of the large quantities of various colored brackets that must be kept in inventory. The use of such brackets also leave a gap between the top of the headrail and the ceiling to which they are attached thereby allowing excessive light to enter the room. Therefore, inventors have created several types of brackets in order to overcome the aforementioned problems:

For example, U.S. Pat. No. 4,607,818 to Georgopoulos discloses a bracket that has two shelves on which the lips of the headrail rest. The headrail is secured to the Georgopoulos bracket by causing one of the flanges to ride up on the edge of one of the shelves until the lip of the flange is resting on the shelf while the other flange is already suspended from the opposite shelf.

Since the support shelves described in the Georgopoulos Patent are not flexible, the flanges of the headrail must be flexible or else the headrail cannot be attached to the bracket. Removal of the headrail is only accomplished by rotating the bracket within the channel of the headrail with a tool, such as a screwdriver, so as to remove the support shelves from under the lips of the headrail. This seriously limits the removal of the bracket to situations where the top of the channel is openly accessible so that the bracket can be manually rotated within the channel. Because of the need to rotate the bracket for removal, the bracket cannot be tightly affixed to the mounting surface. Another problem is that the Georgopoulos bracket must be attached to another angled bracket for vertical mounting.

Another example of a relevant prior art bracket is U.S. Pat. No. 4,802,644 to Oskam. Oskam discloses a complex bracket which causes a U shaped channel to be attached at any place along the open side. However, the bracket is made by the combination of several separate pieces, which make it expensive to produce and difficult to mount.

U.S. Pat. No. 4,224,974 to Anderson, et al. discloses a bracket which uses parallel tangs to lock the bracket in the channel of the headrail, and which releases the bracket from the channel by rotating the base member until the tangs become disengaged. However, in order to release the channel there must be access to the base member so that the base can be rotated. This is not always possible where the channel is necessarily recessed.

To mount the Anderson, et al. bracket to a vertical surface, an additional bracket must be used. Unfortunately, the bracket allows excessive light to enter from above the channel as a result of the base member extending above the channel. Moreover, because the base member must rotate in order to remove the headrail, the bracket cannot be tightly affixed to the mounting surface.

U.S. Pat. No. 4,475,706 to Anderson discloses a bracket that may be secured to the headrail at any point along the channel. However, the bracket is made by a combination of separate parts. Thus, it is expensive to produce and subject to sticking and binding. By necessity, the bracket extends above the top of the U-shaped channel thus causing excessive light to enter.

U.S. Pat. No. 4,938,443 issued to Rowe, while covering a form of venetian blind bracket, does not possess the snap on characteristics of the present invention. Rowe utilizes a cumbersome two-piece structure requiring additional time and energy to assemble.

SUMMARY OF THE INVENTION

The present invention overcomes the numerous problems encountered in the prior art. The invention is comprised of a bracket with a plate mount, or horizontal plate, a front leg, and a bottom leg, depending therefrom. The plate has a bottom surface, a front edge, and a rear edge. The front leg extends downwardly from the bottom surface of the cornice toward the front edge. The front leg terminates in an upwardly extending tine. The front leg and tine together form a lip receiving channel into which one of the lips of the headrail may fit.

The rear leg extends downwardly from the bottom surface of the plate toward the rear edge thereof. The rear leg terminates in a bow portion that bends inwardly toward the front leg. Above the bow portion is a fossa or stop means in which one of the lips of the headrail may rest.

Vertical mounting plate may be secured perpendicular to the rear edge of the plate so that the bracket can be mounted to a wall. But if the intention is to mount the bracket to a ceiling, then the mounting plate is unnecessary since the horizontal plate can be secured to a ceiling directly.

To install the bracket, it is first secured to a wall or ceiling. To secure the bracket to the headrail at any point along the headrail, the front lip of the headrail is placed in the lip receiving channel of the front leg. The headrail is pivoted so that the rear lip comes in contact with the bow portion of the rear leg. The rear lip is forced upward toward the plate thereby pressing the bow portion inward toward the front leg and also pulling the front leg toward the rear leg. When the rear lip passes the bow portion, it comes to rest in the fossa or stop means. The front and rear legs will then return to their original positions thereby forcing both lips upward until they are biased against the bottom surface of the plate. At that point, installation is complete.

It is another purpose of the present invention to provide a single piece bracket which is formed by either molding a flexible material or by the stamping of a flexible material.

A further object of the present invention is to provide a bracket that extends above the headrail by the thickness of the bracket material only so that the bracket is hidden from view.

Another purpose of the invention is to provide a bracket that can be attached at any place along the open side of a venetian blind headrail.

Still another purpose of the invention is to provide a bracket that can be mounted to a headrail to either a vertical or horizontal surface.

Yet another purpose of the invention is to provide a bracket that allows a headrail to be attached and removed while recessed in a pocket or soffit.

Another purpose of the invention is to provide a bracket that can be easily attached and disengaged from the headrail without the assistance of a tool.

Another purpose of the invention is to provide a bracket that minimizes the light gap between the top of the headrail and the wall or ceiling.

These and other objects and advantages of the present invention will become apparent from the following detailed description of the preferred embodiment of the invention without intending to limit the scope of the invention which is set forth in the appended claims.

BRIEF DESCRIPTION OF THE DRAWINGS

The advantages of the invention can be more clearly understood by reference to the drawings in which:

FIG. 1 is an environmental view of the invention;

FIG. 2 is a perspective view of the invention;

FIG. 3 is a rear perspective view of the invention;

DETAILED DESCRIPTION OF THE PREFERRED EMBODIMENT

Figure 7:
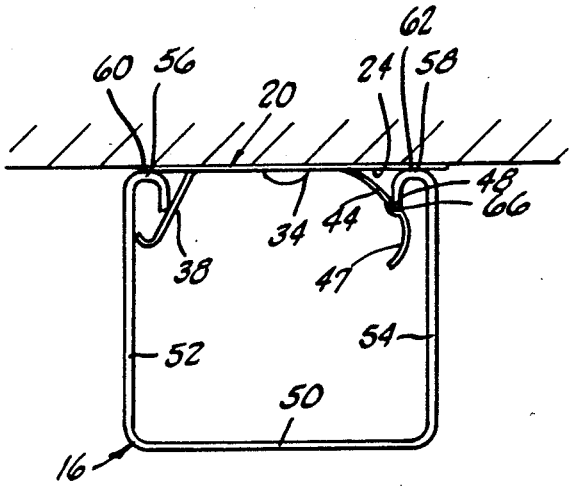
FIG. 7 is a side elevational view of the invention after installation to a ceiling; and, FIG. 8 is a side elevational view demonstrating a position that would be assumed when moving the venetian blind cord to adjust the blinds.

FIG. 1 is an perspective view of the invention 10 installed on a wall 12 above a window frame 14. FIG. 1 also shows a headrail 16 from which conventional venetian blinds 18 are suspended. The venetian blinds 18 are adjusted in any conventional manner. FIG. 2 illustrates the bracket 10. The invention 10 may also be installed within the window frame 14 depending upon the aesthetic and structural needs. The bracket has a plate means or horizontal plate 20 with a top surface 22, a bottom surface 24, a front edge 26, and a rear edge 28. In the preferred embodiment, a vertical mounting section 30 depends from the rear edge 28 and is normal to the bottom surface 24. The vertical mounting section 30 has one or more conventional receiving apertures 32 formed therein for receiving a wall attachment means 34, such as a screw, for securing the section 30 vertically to the wall 12 so that the horizontal plate 20 is perpendicular to the wall 12. When the section 30 is formed with the horizontal plate 20, one or more gussets 31 may be formed at the bond or junction of the plate 20 and vertical section 30. This will add strength to the structure. The plate 20 also has one or more conventional receiving apertures 36 so that it may be mounted to a ceiling if so desired as shown in FIG. 7.

Figure 8:
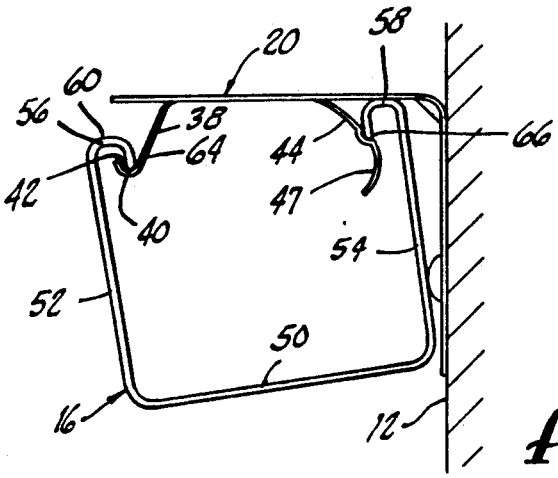

Moving to the heart of the invention, the plate 20 has a resilient front leg 38 that projects downwardly from the bottom surface 24 thereof and toward the front edge 26. The front leg 38 terminates in an up-turned tine 40. The front leg 38 and tine 40 form a channel 42 and it acts as a stop. As will be explained, the leg 38 and possibly channel 42 will serve as a pivot and compression point for the headrail 16 when the headrail 16 is snapped onto the bracket 10. When a cord is pulled to adjust the blinds 18, the headrail 16 tends to be pulled downwardly. When that happens, the tine 40 is forced down into the channel 42 as shown in FIG. 8. Thus, the channel 42 prevents the headrail 16 from becoming disengaged from the bracket 10.

The horizontal plate 20 also has a resilient rear leg 44, that projects downwardly from the bottom surface 24 of the plate 20 and toward the rear edge 28 thereof. The rear leg 44 has a terminal end portion 46 and a fossa or stop means 48. In the preferred embodiment, the fossa or stop means is at approximately the midpoint of the rear leg 44. However, the stop means can be located at any point along the rear leg. At some point, the rear leg 44 arches back toward the front leg 38 forming a bow portion 47. The bow portion 47 of the rear leg 44 has an outer surface 49.

The purpose of the bracket 10 is to mount a conventional venetian blind headrail 16. The headrail 16 includes a web 50 that joins parallel front and rear flanges 52, 54 that are normal to the web 50 forming a U-shaped member. Each flange 52, 54 terminates in an inwardly hooked lip 56, 58. Each lip 56, 58 has a top surface 60, 62 and a terminus 64, 66.

Figure 4:
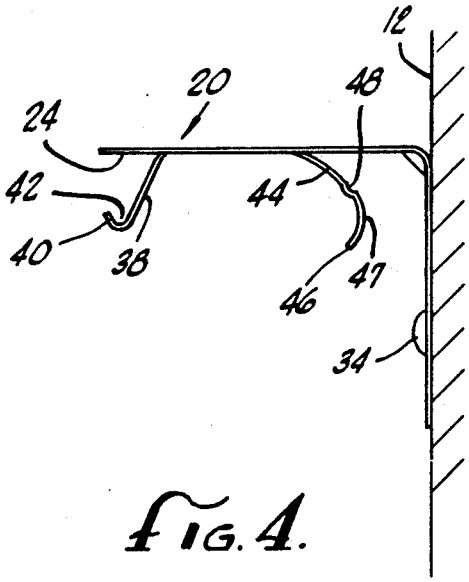
FIG. 4 is a side elevational view of the invention.
Figure 5:
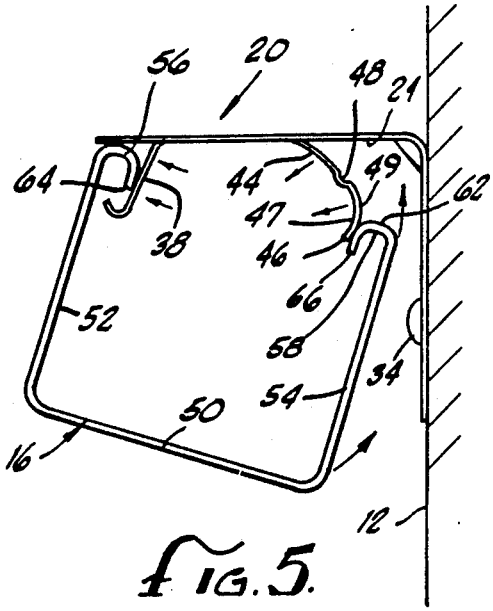
FIG. 5 is a side elevational view of the invention demonstrating how it is installed.

To install the headrail 16 on the bracket 10, the terminus 64 of the front headrail flange 52 is placed so that it rests against the leg 40 or in the channel 42. The headrail 16 is pivoted so that the lip 58 of the rear flange 54 contacts the outer surface 49 of the bow portion 47 as shown in FIG. 5. The lip 58 is forced past the bow portion 47 and upward toward the horizontal plate 20, and the pressure from the lip 58 forces the resilient rear leg 44 inward. See arrows in FIG. 5. When the lip 58 has passed the bow portion 46, the terminus 66 of lip 58 will come to rest in the fossa 48. When the terminus 66 comes to rest in the fossa 48, there no longer will be pressure on the bow portion 46 from the lip 58. Therefore, the rear leg 44 will return to its original position. When that happens, the fossa 48 will rise forcing the lip 58 upward until the top surface 62 of the lip 58 is biased against the bottom surface 24 of the horizontal plate 20. Since the front flange 52 is joined to the rear flange 54 by the web 50, the top surface 60 of lip 56 of the front flange 52 also rises until it is biased against the bottom surface 24 of the plate 20.

Figure 6:
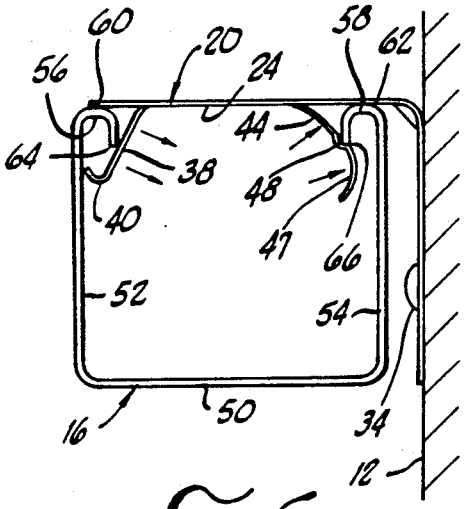
FIG. 6 is a side elevational view of the invention after installation to a wall.

To remove the headrail 16, one presses inward on the front flange 52 thereby flexing the front leg 38 inward. See arrows in FIG. 6. This process moves the headrail 16 toward the wall 12. As a consequence, the terminus 58 of the lip 56 will no longer rest in the fossa 48. Thus, the rear flange 54 can be disengaged from the rear leg 44 thereby allowing the headrail 16 to be removed.

While the preferred embodiment shows the horizontal plate 20 and its depending vertical mounting section 30 where the invention is mounted on wall 12, the section 30 may be eliminated so that just the plate 20 is used and is mounted to a ceiling 60 or top of a window frame 14, see FIG. 7.

It should be noted that the number of brackets 10 to be used will depend on the length of the venetian blind 18 and headrail 16.

For the invention to work effectively, the material used to construct the front leg 38 and rear leg 44 is preferably composed of a resilient material. In the preferred embodiment, the material used is spring steel of 1/32 inch thickness. But the thickness could be more or less than the preferred thickness for the invention to still work so long as the front leg 38 and rear leg 44 retain their resiliency. Furthermore, the invention can be made from materials other than spring steel, such as plastic, so long as the material is sufficiently resilient. The advantage of spring steel or plastic is that the entire bracket 10 can be stamped or molded from a single piece of steel to reduce manufacturing costs.

The invention and its attendant advantages will be understood from the foregoing description and it will be apparent that various changes may be made without departing from the spirit of the invention.

I claim:

1. A mounting bracket for securing a venetian blind headrail to a surface, said headrail including a web having front and rear parallel flanges extending therefrom that are both normal to said web, each of said flanges terminating in an inwardly projecting lip, said mounting bracket comprising:

a plate means having a top surface, a bottom surface, a front edge, and a rear edge;

a front leg comprised of a resilient material projecting downwardly from said bottom surface of said plate means and outwardly toward said front edge, said front leg having a terminal end portion, a tine projecting upwardly and outwardly from said terminal end portion of said front leg, said tine and said front leg forming a lip receiving channel;

a rear leg comprised of a resilient material projecting downwardly from said bottom surface of said plate means and outwardly toward said rear edge terminating in an inwardly extending bow portion, and a stop means formed in said rear leg; whereby said bracket is adapted to receive said headrail wherein said lip of said front flange of said headrail is biased against said front leg and said bracket is pivoted inwardly and upwardly with said other lip engaging and being biased against said bow portion flexing said front and rear legs toward each other until said other lip slides over said bow portion and engages said stop means, whereupon said flexed legs are adapted to return to their original positions urging said flanges and said lips upwardly to engage said plate means.

2. The bracket of claim 1 that includes a vertical mounting section depending from said rear edge of the said plate means.

3. The bracket of claim 2 wherein at least one strengthening gusset is interposed at the junction of said plate means and said depending vertical mounting section.

4. The bracket of claim 3 wherein there are a plurality of gussets.

5. The bracket of claim 1 wherein said bracket is of a unitary construction.

6. The bracket of claim 2 wherein said bracket is of a unitary construction.

7. The bracket of claim 1 wherein said bracket is made of spring steel having 1/32 inch thickness.

8. The bracket of claim 1 wherein said bracket is formed of plastic and is of a unitary construction.

9. In a mounting bracket adapted to receive a venetian blind headrail for retaining said headrail above a window, said headrail including a U-shaped member having generally parallel legs terminating at ends in inturned curved lips with a web extending between said legs at an opposite end thereof, the improvement comprising:

a horizontal plate having a front and rear edge and generally parallel side walls extending therebetween, a front resilient headrail retaining leg struck from said horizontal plate and depending angularly downward and outward toward said front edge, and a rear resilient headrail retaining leg struck from said horizontal plate and depending angularly downward and rearward toward said rear edge;

said front leg having a biasing surface engagable by said curved lip of said front leg in an initial movement;

said rear leg including an end bow portion curved inwardly and a stop means formed in said rear leg, whereby when said rear leg of said headrail is urged upward in a second movement it will bias over said bow portion and upon further upward urging, seat in said stop means.

10. In a mounting bracket defined in claim 9 wherein said front and rear legs are directly aligned one with the other.

11. In a mounting bracket defined in claim 9 wherein said front and rear legs are resilient and adapted to give during insertion of said headrail and return to their original positions when said headrail is seated to insure a biasing and releasable locking of said curved flanges against said horizontal plate.

* * * * *